US006778962B1

(12) United States Patent
Kasai et al.

(10) Patent No.: US 6,778,962 B1
(45) Date of Patent: Aug. 17, 2004

(54) SPEECH SYNTHESIS WITH PROSODIC MODEL DATA AND ACCENT TYPE

(75) Inventors: Osamu Kasai, Tokyo (JP); Toshiyuki Mizoguchi, Tokyo (JP)

(73) Assignees: Konami Corporation, Tokyo (JP); Konami Computer Entertainment Tokyo, Inc., Tokyo (JP)

( * ) Notice: Subject to any disclaimer, the term of this patent is extended or adjusted under 35 U.S.C. 154(b) by 615 days.

(21) Appl. No.: 09/621,545

(22) Filed: Jul. 21, 2000

(30) Foreign Application Priority Data

Jul. 23, 1999 (JP) ..... H11-208606

(51) Int. Cl.[7] ..... G10L 13/08
(52) U.S. Cl. ..... 704/266; 704/268; 704/269
(58) Field of Search ..... 704/258, 260, 704/266, 267, 268, 269

(56) References Cited

U.S. PATENT DOCUMENTS 5,384,893 A * 1/1995 Hutchins ..... 704/267
5,905,972 A * 5/1999 Huang et al. ..... 704/268
5,950,152 A 9/1999 Arai et al.
6,029,131 A * 2/2000 Bruckert ..... 704/260
6,035,272 A * 3/2000 Nishimura et al. ..... 704/258
6,144,939 A * 11/2000 Pearson et al. ..... 704/258
6,226,614 B1 * 5/2001 Mizuno et al. ..... 704/260
6,260,016 B1 * 7/2001 Holm et al. ..... 704/260
6,317,713 B1 * 11/2001 Tenpaku ..... 704/261
6,334,106 B1 * 12/2001 Mizuno et al. ..... 704/260
6,405,169 B1 * 6/2002 Kondo et al. ..... 704/258
6,470,316 B1 * 10/2002 Chihara ..... 704/267
6,477,495 B1 * 11/2002 Nukaga et al. ..... 704/268
6,499,014 B1 * 12/2002 Chihara ..... 704/260
6,516,298 B1 * 2/2003 Kamai et al. ..... 704/260
6,665,641 B1 * 12/2003 Coorman et al. ..... 704/260

* cited by examiner

*Primary Examiner*—Richemond Dorvil
*Assistant Examiner*—Martin Lerner
(74) *Attorney, Agent, or Firm*—Lowe Hauptman Gilman & Berner, LLP

(57) ABSTRACT

A speech synthesizing method includes determining the accent type of the input character string, selecting the prosodic model data from a prosody dictionary for storing typical ones of the prosodic models representing the prosodic information for the character strings in a word dictionary, based on the input character string and the accent type, transforming the prosodic information of the prosodic model when the character string of the selected prosodic model is not coincident with the input character string, selecting the waveform data corresponding to each character of the input character string from a waveform dictionary, based on the prosodic model data after transformation, and connecting the selected waveform data with each other. Therefore, a difference between an input character string and a character string stored in a dictionary is absorbed, then it is possible to synthesize a natural voice.

19 Claims, 11 Drawing Sheets

Fig. 2

| Character string | Mora number | Accent type | Syllabic information |
|---|---|---|---|
| kamaikun | 5 | | ..... |
| sasaikun | 5 | | ..... |
| shisaikun | 5 | | ..... |
| iroirokun | 6 | | ..... |
| irokun | 4 | | ..... |
| ⋮ | ⋮ | ⋮ | ⋮ |

Fig. 8

Reconstructed phoneme

| | | | | |
|---|---|---|---|---|
| sa | ka | i | ku | n |
| sa | aka | ai | iku | un |

Transformation model

| V interval 1 | | V interval 2 | |
|---|---|---|---|
| frq | vol | frq | vol |
| | | 450 | 1000 |

| Phoneme candidate | V interval 1 | | V interval 2 | |
|---|---|---|---|---|
| | frq | vol | frq | vol |
| sa−001 | | | 440 | 800 |
| sa−002 | | | 500 | 1050 |
| sa−003 | | | 400 | 950 |

Fig. 9

Reconstructed phoneme

| | | | | |
|---|---|---|---|---|
| sa | ka | i | ku | n |
| sa | aka | ai | iku | un |

Transformation model

| V interval 1 | | V interval 2 | |
|---|---|---|---|
| frq | vol | frq | vol |
| 450 | 1000 | 400 | 800 |

| Phoneme candidate | V interval 1 | | V interval 2 | |
|---|---|---|---|---|
| | frq | vol | frq | vol |
| aka−001 | 400 | 1000 | 450 | 800 |
| aka−002 | 460 | 800 | 410 | 1000 |

SPEECH SYNTHESIS WITH PROSODIC MODEL DATA AND ACCENT TYPE

BACKGROUND OF THE INVENTION

1. Field of the Invention

The present invention relates to improvements in a speech synthesizing method, a speech synthesis apparatus and a computer-readable medium recording a speech synthesis program.

2. Description of the Related Art

The conventional method for outputting various spoken messages (language spoken by men) from a machine was a so-called speech synthesis method involving storing ahead speech data of a composition unit corresponding to various words making up a spoken message, and combining the speech data in accordance with a character string (text) input at will.

Generally, in such speech synthesis method, the phoneme information such as a phonetic symbol which corresponds to various words (character strings) used in our everyday life, and the prosodic information such as an accent, an intonation, and an amplitude are recorded in a dictionary. An input character string is analyzed. If a same character string is recorded in the dictionary, speech data of a composition unit are combined and output, based on its information. Or otherwise, the information is created from the input character string in accordance with predefined rules, and speech data of a composition unit are combined and output, based on that information.

However, in the conventional speech synthesis method as above described, for a character string not registered in the dictionary, the information corresponding to an actual spoken message, or particularly the prosodic information, can not be created. Consequently, there was a problem of producing an unnatural voice or different voice from an intended one.

SUMMARY OF THE INVENTION

It is an object of the present invention to provide a speech synthesis method which is able to synthesize a natural voice by absorbing a difference between a character string input at will and a character string recorded in a dictionary, a speech synthesis apparatus, and a computer-readable medium having a speech synthesis program recorded thereon.

To attain the above object, the present invention provides a speech synthesis method for creating voice message data corresponding to an input character string, using a word dictionary for storing a large number of character strings containing at least one character with its accent type, a prosody dictionary for storing typical prosodic model data among prosodic model data representing the prosodic information for the character strings stored in the word dictionary, and a waveform dictionary for storing voice waveform data of a composition unit with recorded voice, the method comprising determining the accent type of the input character string, selecting prosodic model data from the prosody dictionary based on the input character string and the accent type, transforming the prosodic information of the prosodic model data in accordance with the input character string when the character string of the selected prosodic model data is not coincident with the input character string, selecting the waveform data corresponding to each character of the input character string from the waveform dictionary, based on the prosodic model data, and connecting the selected waveform data.

According to the present invention, when an input character string is not registered in the dictionary, the prosodic model data approximating this character string can be utilized. Further, its prosodic information can be transformed in accordance with the input character string, and the waveform data can be selected, based on the transformed information data. Consequently, it is possible to synthesize a natural voice.

Herein, the selection of prosodic model data can be made by, using a prosody dictionary for storing the prosodic model data containing the character string, mora number, accent type and syllabic information, creating the syllabic information of an input character string, extracting the prosodic model data having the mora number and accent type coincident to that of the input character string from the prosody dictionary to have a prosodic model data candidate, creating the prosodic reconstructed information by comparing the syllabic information of each prosodic model data candidate and the syllabic information of the input character string, and selecting the optimal prosodic model data based on the character string of each prosodic model data candidate and the prosodic reconstructed information thereof.

In this case, if there is any of the prosodic model data candidates having all its phonemes coincident with the phonemes of the input character string, this prosodic model data candidate is made the optimal prosodic model data. If there is no candidate having all its phonemes coincident with the phonemes of the input character string, a candidate having a greatest number of phonemes coincident with the phonemes of the input character string among the prosodic model data candidates is made the optimal prosodic model data. If there are plural candidates having a greatest number of phonemes coincident with the phonemes of the input character string, a candidate having a greatest number of phonemes consecutively coincident with the phonemes of the input character string is made the optimal prosodic model data. Thereby, it is possible to select the prosodic model data containing the phoneme which is identical to and at the same position as the phoneme of the input character string, or a restored phoneme (hereinafter also referred to as a reconstructed phoneme), most coincidentally and consecutively, leading to synthesis of more natural voice.

The transformation of prosodic model data is effected such that when the character string of the selected prosodic model data is not coincident with the input character string, a syllable length after transformation is calculated from an average syllable length calculated beforehand for all the characters used for the voice synthesis and a syllable length in the prosodic model data for each character that is not coincident in the prosodic model data. Thereby, the prosodic information of the selected prosodic model data can be transformed in accordance with the input character string. It is possible to effect more natural voice synthesis.

Further, the selection of waveform data is made such that the waveform data of pertinent phoneme in the prosodic model data is selected from the waveform dictionary for a reconstructed phoneme among the phonemes constituting the input character string, and the waveform data of corresponding phoneme having a frequency closest to that of the prosodic model data is selected from the waveform dictionary for other phonemes. Thereby, the waveform data closest to the prosodic model data after transformation can be selected. It is possible to enable the synthesis of more natural voice.

To attain the above object, the present invention provides a speech synthesis apparatus for creating the voice message data corresponding to an input character string, comprising a word dictionary for storing a large number of character strings containing at least one character with its accent type, a prosody dictionary for storing typical prosodic model data among prosodic model data representing the prosodic information for the character strings stored in said word dictionary, and a waveform dictionary for storing voice waveform data of a composition unit with recorded voice, accent type determining means for determining the accent type of the input character string, prosodic model selecting means for selecting the prosodic model data from the prosody dictionary based on the input character string and the accent type, prosodic transforming means for transforming the prosodic information of the prosodic model data in accordance with the input character string when the character string of the selected prosodic model data is not coincident with the input character string, waveform selecting means for selecting the waveform data corresponding to each character of the input character string from the waveform dictionary, based on the prosodic model data, and waveform connecting means for connecting the selected waveform data with each other.

The speech synthesis apparatus can be implemented by a computer-readable medium having a speech synthesis program recorded thereon, the program, when read by a computer, enabling the computer to operate as a word dictionary for storing a large number of character strings containing at least one character with its accent type, a prosody dictionary for storing typical prosodic model data among prosodic model data representing the prosodic information for the character strings stored in the word dictionary, and a waveform dictionary for storing voice waveform data of a composition unit with the recorded voice, accent type determining means for determining the accent type of an input character string, prosodic model selecting means for selecting the prosodic model data from the prosody dictionary based on the input character string and the accent type, prosodic transforming means for transforming the prosodic information of the prosodic model data in accordance with the input character string when the character string of the selected prosodic model data is not coincident with the input character string, waveform selecting means for selecting the waveform data corresponding to each character of the input character string from the waveform dictionary, based on the prosodic model data, and waveform connecting means for connecting the selected waveform data with each other.

The above and other objects, features, and benefits of the present invention will be clear from the following description and the accompanying drawings.

BRIEF DESCRIPTION OF THE DRAWINGS

FIG. 2 is a diagram illustrating a prosody dictionary;

FIG. 8 is a diagram illustrating specifically the waveform selection process;

FIG. 9 is a diagram illustrating specifically the waveform selection process;

DESCRIPTION OF THE PREFERRED EMBODIMENTS

Figure 1:
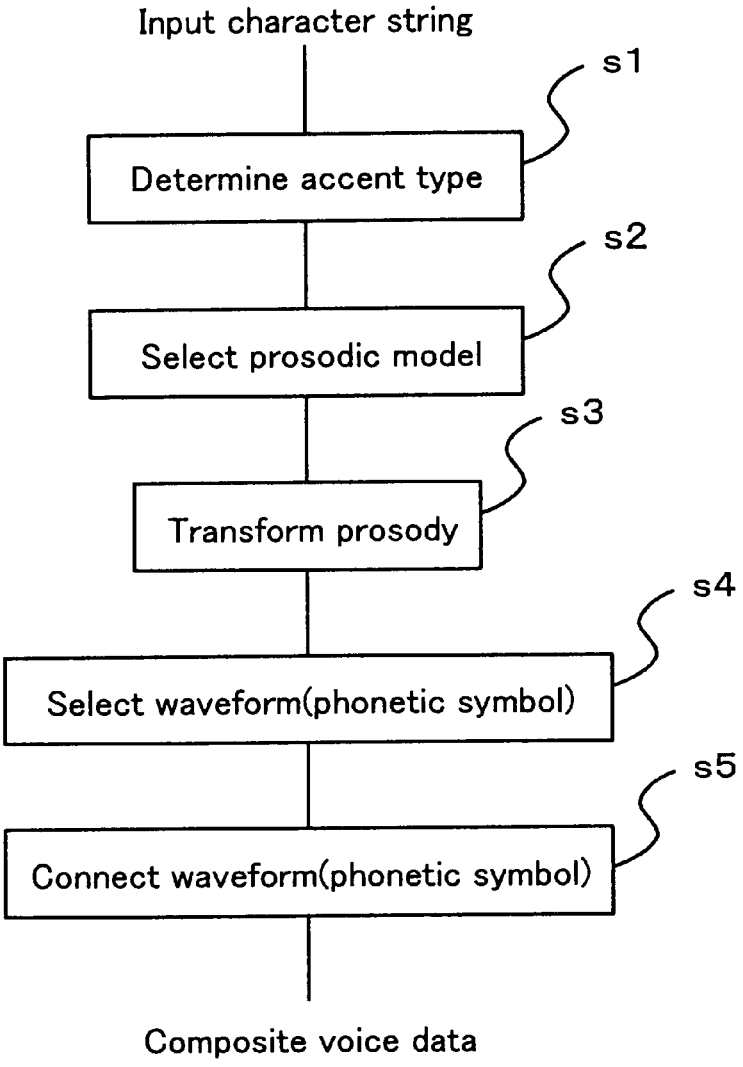
FIG. 1 is a flowchart showing an overall speech synthesizing method of the present invention.

FIG. 1 shows the overall flow of a speech synthesizing method according to the present invention.

Firstly, a character string to be synthesized is input from input means or a game system, not shown. And its accent type is determined based on the word dictionary and so on (s1). Herein, the word dictionary stores a large number of character strings (words) containing at least one character with its accent type. For example, it stores numerous words representing the name of a player character to be expected to input (with "kun" (title of courtesy in Japanese) added after the actual name), with its accent type.

Specific determination is made by comparing an input character string and a word stored in the word dictionary, and adopting the accent type if the same word exists, or otherwise, adopting the accent type of the word having similar character string among the words having the same mora number.

If the same word does not exist, the operator (or game player) may select or determine a desired accent type from all the accent types that can appear for the word having the same mora number as the input character string, using input means, not shown.

Then, the prosodic model data is selected from the prosody dictionary, based on the input character string and the accent type (s2). Herein, the prosody dictionary stores typical prosodic model data among the prosodic model data representing the prosodic information for the words stored in the word dictionary.

If the character string of the selected prosodic model data is not coincident with the input character string, the prosodic information of the prosodic model data is transformed in accordance with the input character string (s3).

Based on the prosodic model data after transformation (since no transformation is made if the character string of the selected prosodic model data is coincident with the input character string, the prosodic model data after transformation may include the prosodic model data not transformed in practice), the waveform data corresponding to each character of the input character string is selected from the waveform dictionary (s4). Herein, the waveform dictionary stores the voice waveform data of a composition unit with the recorded voices, or voice waveform data (phonemic symbols) in accordance with a well-known VCV phonemic system in this embodiment.

Lastly, the selected waveform data are connected to create the composite voice data (s5).

A prosodic model selection process will be described below in detail.

FIG. 2 illustrates an example of a prosody dictionary, which stores a plurality of prosodic model data containing the character string, mora number, accent type and syllabic information, namely, a plurality of typical prosodic model data for a number of character strings stored in the word dictionary. Herein, the syllabic information is composed of, for each character making up a character string, the kind of syllable which is C: consonant+vowel, V: vowel, N': syllabic nasal, Q': double consonant, L: long sound, or #: voiceless sound, and the syllable number indicating the number of voice denotative symbol (A: 1, I: 2, U: 3, E: 4, O: 5, KA: 6, . . . ) represented in accordance with the ASJ (Acoustics Society of Japan) notation (omitted in FIG. 2). In practice, the prosody dictionary has the detailed information as to frequency, volume and syllabic length of each phoneme for every prosodic model data, but which are omitted in the figure.

Figure 3:
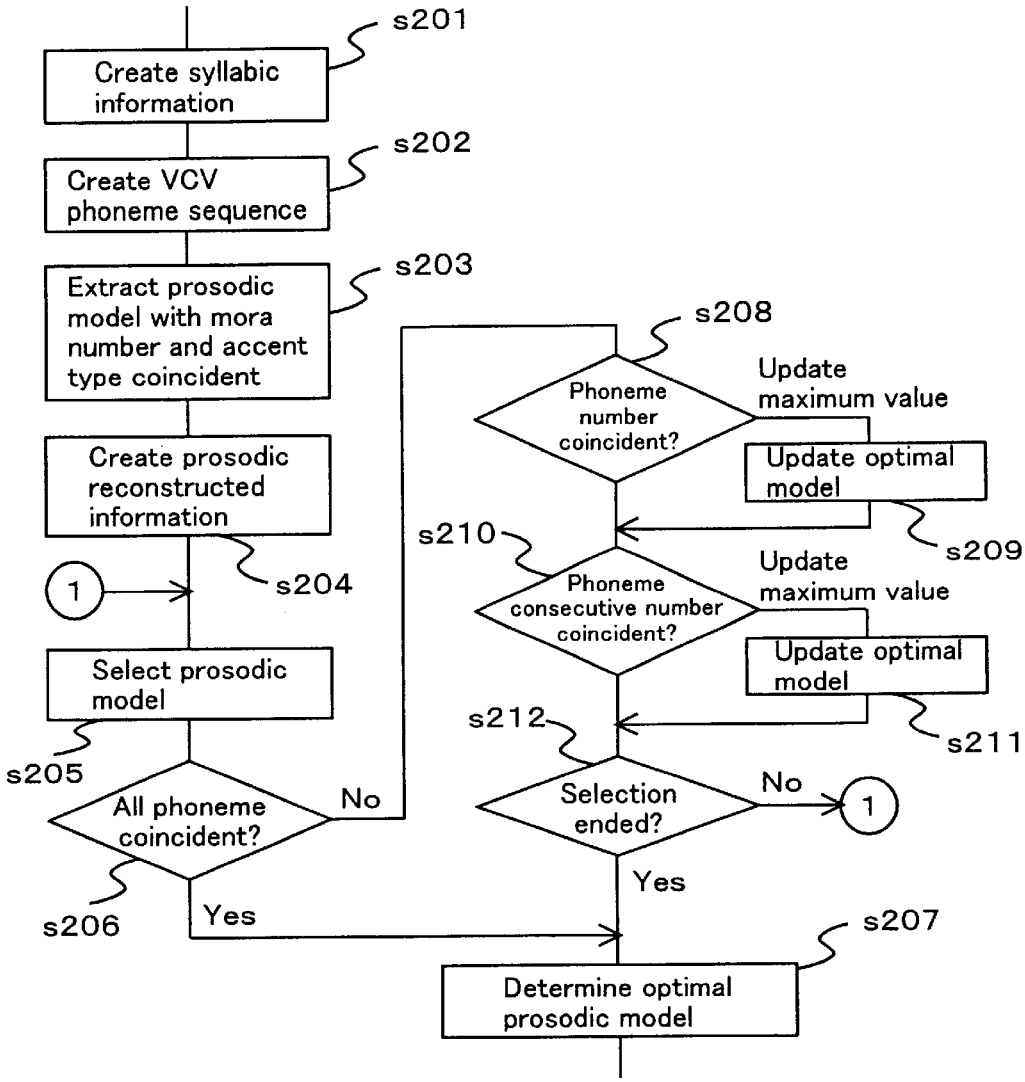
FIG. 3 is a flowchart showing the details of a prosodic model selection process.
Figure 4:
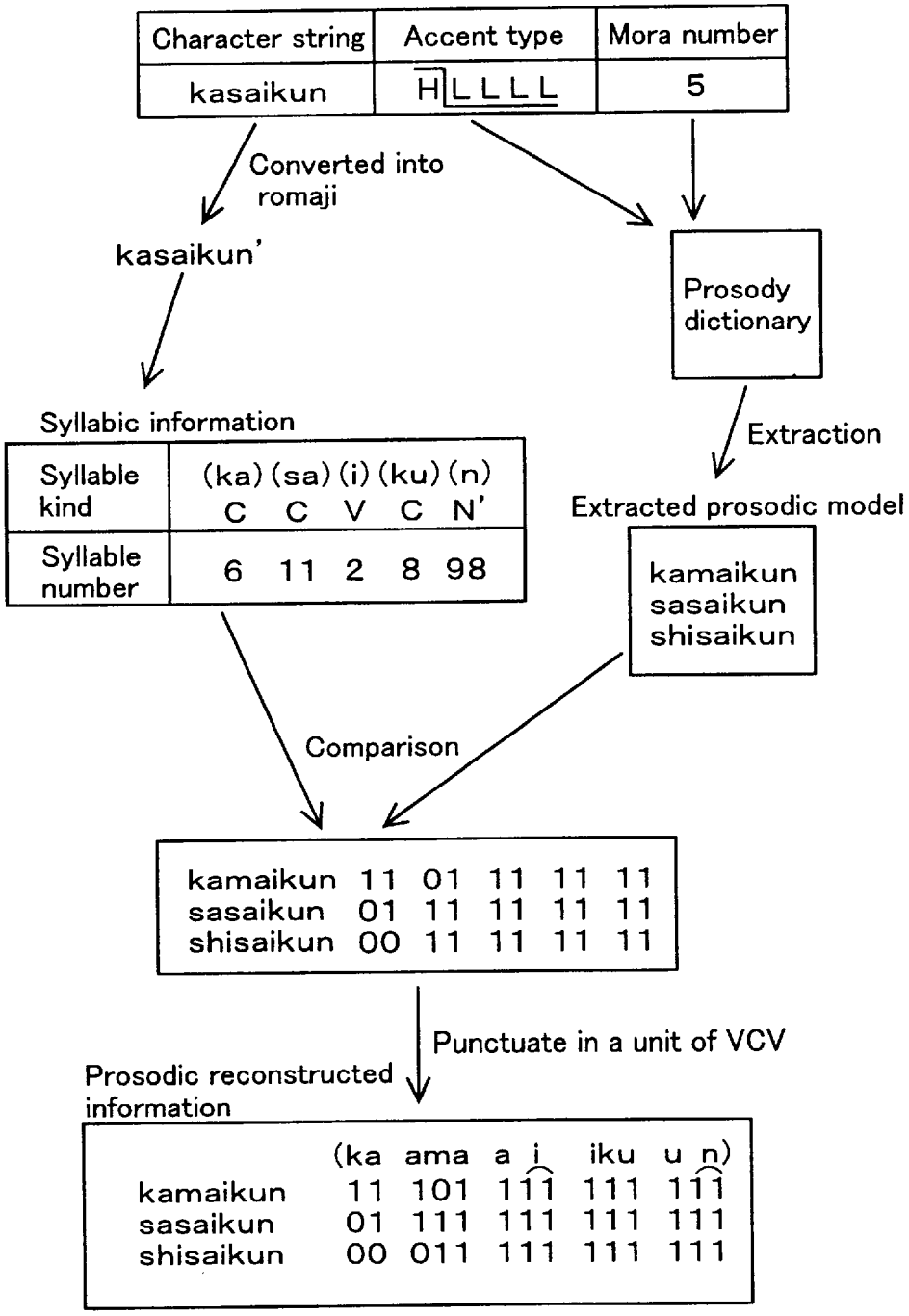
FIG. 4 is a diagram illustrating specifically the prosodic model selection process.

FIG. 3 is a detailed flowchart of the prosodic model selection process. FIG. 4 illustrates specifically the prosodic model selection process. The prosodic model selection process will be described below in detail.

Firstly, the syllabic information of an input character string is created (s201). Specifically, a character string denoted by hiragana is spelled in romaji (phonetic symbol by alphabetic notation) in accordance with the above-mentioned ASJ notation to create the syllabic information composed of the syllable kind and the syllable number. For example, in a case of a character string "kasaikun," it is spelled in romaji "kasaikun'", the syllabic information composed of the syllable kind "CCVCN'" and the syllable number "6, 11, 2, 8, 98" is created, as shown in FIG. 4.

To see the number of reconstructed phonemes in a unit of VCV phoneme, a VCV phoneme sequence for the input character string is created (s202). For example, in the case of "kasaikun," the VCV phoneme sequence is "ka asa ai iku un."

On the other hand, only the prosodic model data having the accent type and mora number coincident with the input character string is extracted from the prosodic model data stored in the prosody dictionary to have a prosodic model data candidate (s203). For instance, in an example of FIGS. 2 and 4, "kamaikun," "sasaikun," and "shisaikun" are extracted.

The prosodic reconstructed information is created by comparing its syllabic information and the syllabic information of the input character string for each prosodic model data candidate (s204). Specifically, the prosodic model data candidate and the input character string are compared in respect of the syllabic information for every character. It is attached with "11" if the consonant and vowel are coincident, "01" if the consonant is different but the vowel is coincident, "10" if the consonant is coincident but the vowel is different, "00" if the consonant and the vowel are different. Further, it is punctuated in a unit of VCV.

For instance, in the example of FIGS. 2 and 4, the comparison information is such that "kamaikun" has "11 01 11 11 11," "sasaikun" has "01 11 11 11 11," and "shisaikun" has "00 11 11 11 11," and the prosodic reconstructed information is such that "kamaikun" has "11 101 111 111 111," "sasaikun" has "01 111 111 111 111," and "shisaikun" has "00 011 111 111 111."

One candidate is selected from the prosodic model data candidates (s205). A check is made to see whether or not its phoneme is coincident with the phoneme of the input character string in a unit of VCV, namely, whether the prosodic reconstructed information is "11" or "111" (s206). Herein, if all the phonemes are coincident, this is determined to be the optimal prosodic model data (s207).

On the other hand, if there is any phoneme not coincident with the phoneme of the input character string, the number of coincident phonemes in a unit of VCV, namely, the number of "11" or "111" in the prosodic reconstructed information is compared (initial value is 0) (s208). If taking the maximum value, its model is a candidate for the optimal prosodic model data (s209). Further, the consecutive number of phonemes coincident in a unit of VCV, namely, the consecutive number of "11" or "111" in the prosodic reconstructed information is compared (initial value is 0) (s210). If taking the maximum value, its model is made a candidate for the optimal prosodic model data (s211).

The above process is repeated for all the prosodic model data candidates (s212). If the candidate with all the phonemes coincident, or having a greatest number of coincident phonemes, or if there are plural models with the greatest number of coincident phonemes, a greatest consecutive number of coincident phonemes is determined to be the optimal prosodic model data.

In the example of FIGS. 2 and 4, there is no model which has the same character string as the input character string. The number of coincident phonemes is 4 for "kamaikun," 4 for "sasaikun," and 3 for "shisaikun." The consecutive number of coincident phonemes is 3 for "kamaikun," and 4 for "sasaikun." As a result, "sasaikun" is determined to be the optimal prosodic model data.

The details of a prosodic transformation process will be described below.

Figure 5:
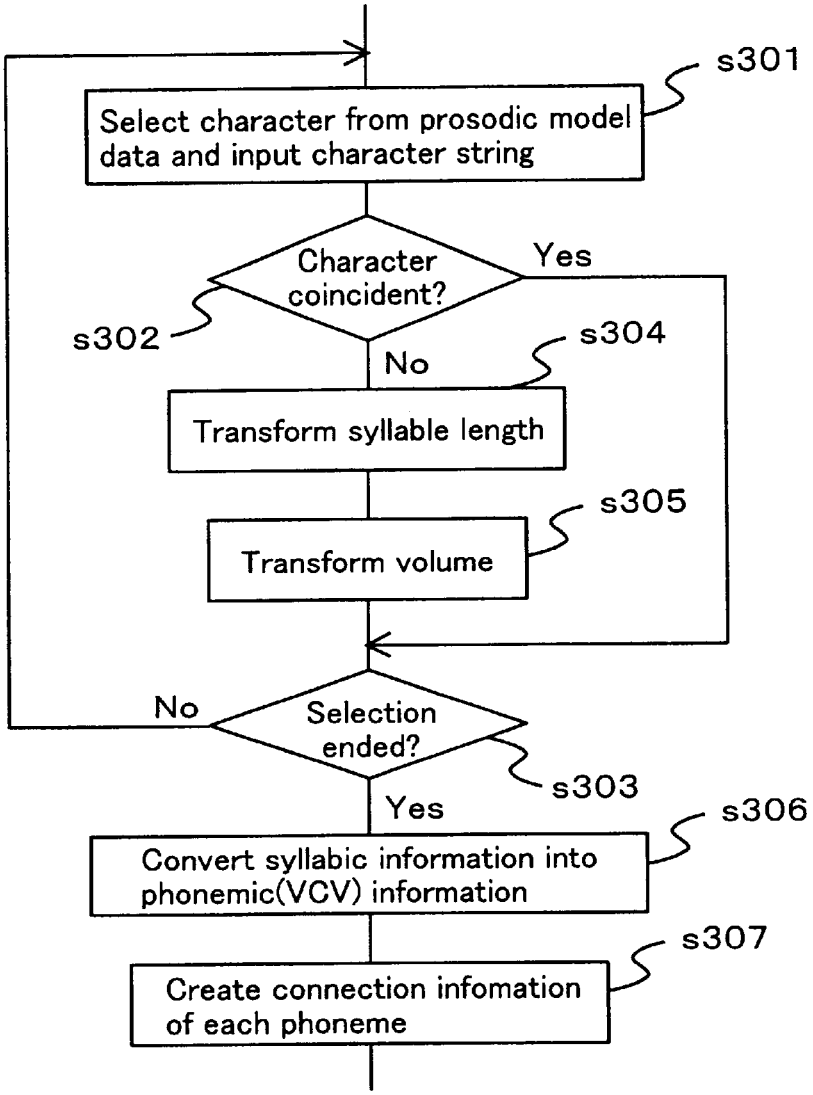
FIG. 5 is a flowchart showing the details of a prosodic transformation process.
Figure 6:
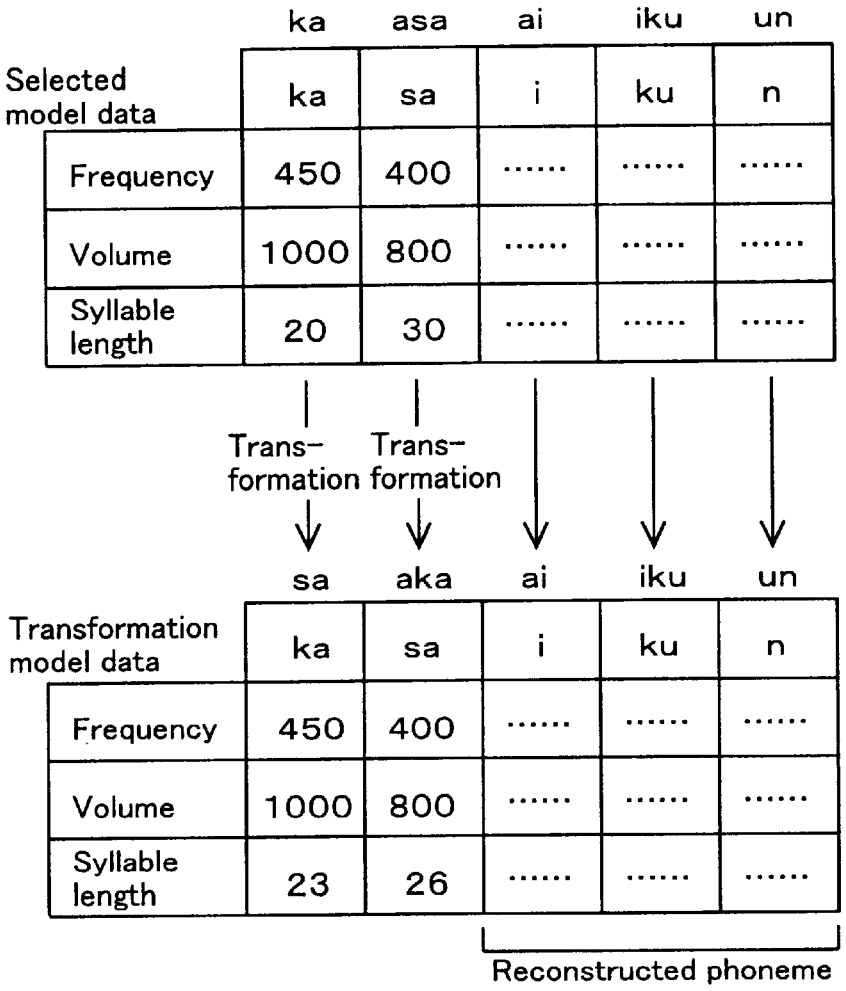
FIG. 6 is a diagram illustrating specifically the prosodic transformation.

FIG. 5 is a detailed flowchart of the prosodic transformation process. FIG. 6 illustrates specifically the prosodic transformation process. This prosodic transformation process will be described below.

Firstly, the character of the prosodic model data selected as above and the character of the input character string are selected from the top each one character at a time (s301). At this time, if the characters are coincident (s302), the selection of a next character is performed (s303). If the characters are not coincident, the syllable length after transformation corresponding to the character in the prosodic model data is obtained in the following way. Also, the volume after transformation is obtained, as required. Then, the prosodic model data is rewritten (s304, s305).

Supposing that the syllable length in the prosodic model data is x, the average syllable length corresponding to the character in the prosodic model data is x', the syllable length after transformation is y, and the average syllable length corresponding to the character after transformation is y', the syllable length after transformation is calculated as $$y=y'\times(x/x')$$

Note that the average syllable length is calculated for every character and stored beforehand.

In an instance of FIG. 6, the input character string is "sakaikun," and the selected prosodic model data is "kasaikun." In a case where a character "ka" in the prosodic model data is transformed in accordance with a character "sa" in the input character string, supposing that the average syllable length of character "ka" is 22, and the average syllable length of character "sa" is 25, the syllable length of character "sa" after transformation is Syllable length of "*sa*"=average syllable length of "*sa*"×(syllable length of "*ka*"/average syllable length of "*ka*")=25×(20/22)≈23

Similarly, in a case where a character "sa" in the prosodic model data is transformed in accordance with a character "ka" in the input character string, the syllable length of character "ka" after transformation is Syllable length of "*ka*"=average syllable length of "*ka*"×(syllable length of "*sa*"/average syllable length of "*sa*")=22×(30/25)≈26

The volume may be transformed by the same calculation of the syllable length, or the values in the prosodic model data may be directly used.

The above process is repeated for all the characters in the prosodic model data, and then converted into the phonemic (VCV) information (s306). The connection information of phonemes is created (s307).

In a case where the input character string is "sakaikun," and the selected prosodic model data is "kasaikun," three characters "i," "ku," "n" are coincident in respect of the position and the syllable. These characters are restored phonemes (reconstructed phonemes).

The details of a waveform selection process will be described below.

Figure 7:
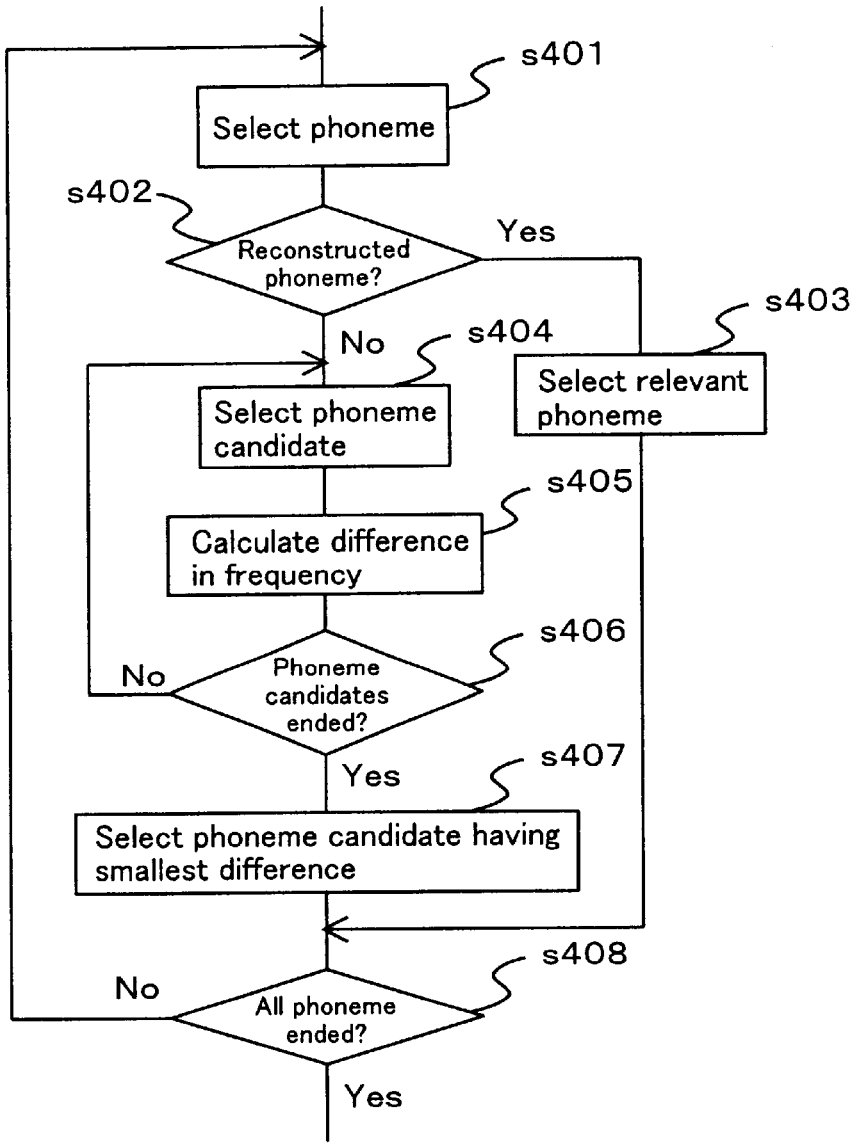
FIG. 7 is a flowchart showing the details of a waveform selection process.

FIG. 7 is a detailed flowchart showing the waveform selection process. This waveform selection process will be described below in detail.

Firstly, the phoneme making up the input character string is selected from the top one phoneme at a time (s401). If this phoneme is the aforementioned reconstructed phoneme (s402), the waveform data of pertinent phoneme in the prosodic model data selected and transformed is selected from the wave form dictionary (s403).

If this phoneme is not the reconstructed phoneme, the phoneme having the same delimiter in the waveform dictionary is selected as a candidate (s404). A difference in frequency between that candidate and the pertinent phoneme in the prosodic model data after transformation is calculated (s405). In this case, if there are two V intervals of phoneme, the accent type is considered. The sum of differences in frequency for each V interval is calculated. This step is repeated for all the candidates (s406). The waveform data of phoneme for a candidate having the minimum value of difference (sum of differences) is selected from the waveform dictionary (s407). At this time, the volumes of phoneme candidate may be supplementally referred to, and those having the extremely small value may be removed.

The above process is repeated for all the phonemes making up the input character string (s408).

FIGS. 8 and 9 illustrate specifically the waveform selection process. Herein, of the VCV phonemes "sa aka ai iku un" making up the input character string "sakaikun," the frequency and volume value of pertinent phoneme in the prosodic model data after transformation, and the frequency and volume value of phoneme candidate are listed for each of "sa" and "aka" which are not reconstructed phoneme.

More specifically, FIG. 8 shows the frequency "450" and volume value "1000" of phoneme "sa" in the prosodic model data after transformation, and the frequencies "440," "500," "400" and volume values "800," "1050," "950" of three phoneme candidates "sa-001," "sa-002" and "sa-003." In this case, a closest phoneme candidate "sa-001" with the frequency "440" is selected.

FIG. 9 shows the frequency "450" and volume value "1000" in the V interval 1 for a phoneme "aka" in the prosodic model data after transformation, the frequency "400" and volume value "800" in the V interval 2 for a phoneme "aka" in the prosodic model data after transformation, the frequencies "400," "460" and volumes values "1000," "800" in the V interval 1 for two phonemes "aka-001" and "aka-002" and the frequencies "450," "410" and volumes values "800," "1000" in the V interval 2 for two phonemes "aka-001" and "aka-002". In this case, a phoneme candidate "aka-002" is selected in which the sum of differences in frequency for each of V interval 1 and V interval 2 ($|450-400|+|400-450|=100$ for the phoneme candidate "aka-001" and $|450-460|+|400-410|=20$ for phoneme candidate"aka-002") is smallest.

Figure 10:
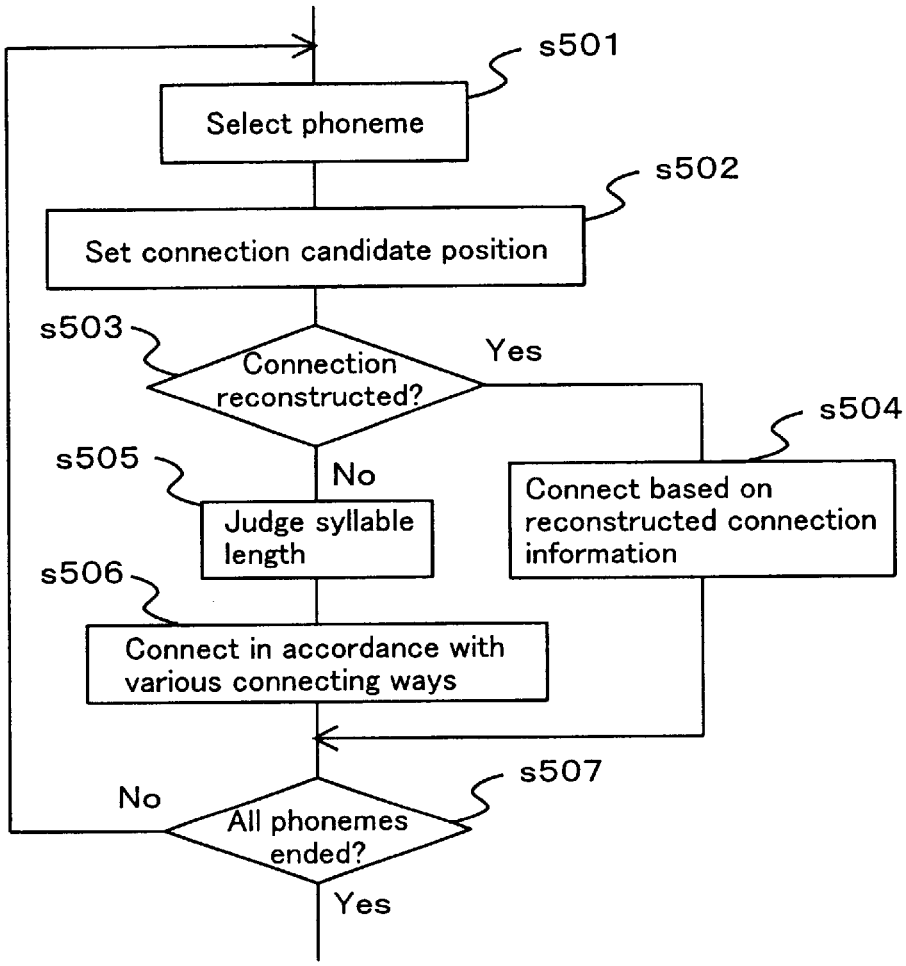
FIG. 10 is a flowchart showing the details of a waveform connection process.

FIG. 10 is a detailed flowchart of a waveform connection process. This waveform connection process will be described below in detail.

Firstly, the waveform data for the phoneme selected as above is selected from the top one waveform at a time (s501). The connection candidate position is set up (s502). In this case, if the connection is restorable (s503), the waveform data is connected, based on the reconstructed connection information (s504).

If it is not restorable, the syllable length is judged (s505). Then, the waveform data is connected in accordance with various ways of connection (vowel interval connection, long sound connection, voiceless syllable connection, double consonant connection, syllabic nasal connection) (s506).

The above process is repeated for the waveform data for all the phonemes to create the composite voice data (s507).

Figure 11:
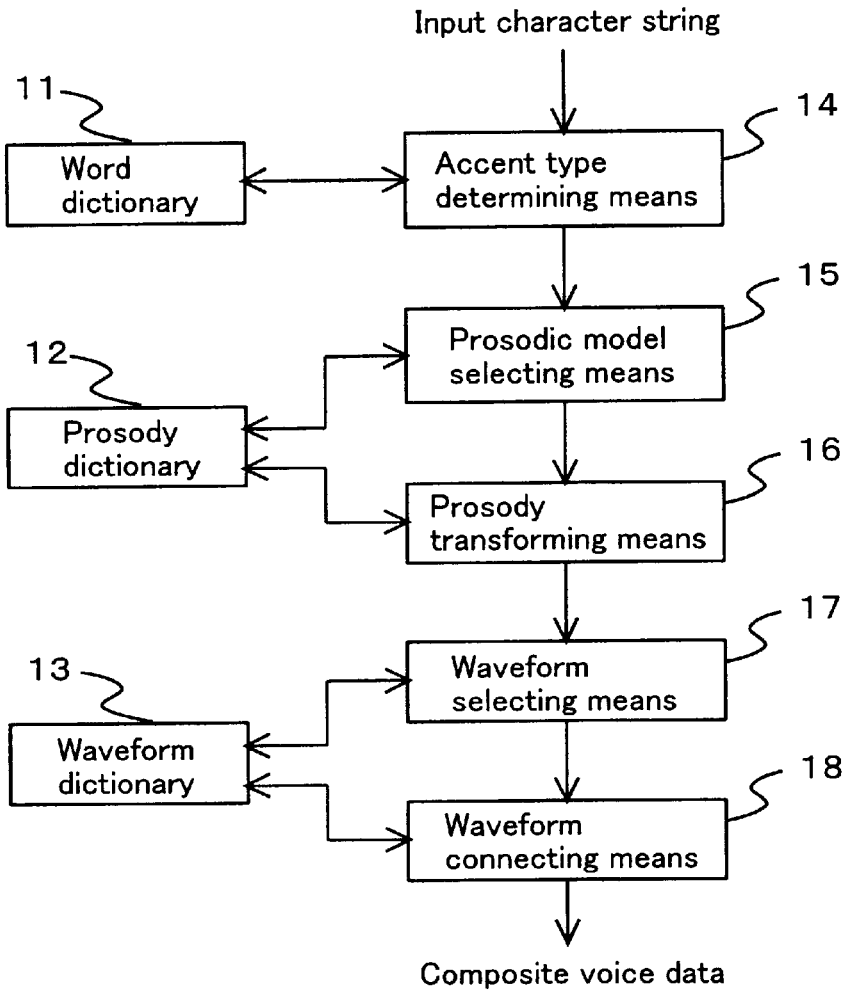
FIG. 11 is a functional block diagram of a speech synthesis apparatus according to the present invention.

FIG. 11 is a functional block diagram of a speech synthesis apparatus according to the present invention. In the figure, reference numeral 11 denotes a word dictionary; 12, a prosody dictionary; 13, a waveform dictionary; 14, accent type determining means; 15, prosodic model selecting means; 16, prosody transforming means; 17, waveform selecting means; and 18, waveform connecting means.

The word dictionary 11 stores a large number of character strings (words) containing at least one character with its accent type. The prosody dictionary 12 stores a plurality of prosodic model data containing the character string, mora number, accent type and syllabic information, or a plurality of typical prosodic model data for a large number of character strings stored in the word dictionary. The waveform dictionary 13 stores voice waveform data of a composition unit with recorded voices.

The accent type determining means 14 involves comparing a character string input from input means or a game system and a word stored in the word dictionary 11, and if there is any same word, determining its accent type as the accent type of the character string, or otherwise, determining the accent type of the word having the similar character string among the words having the same mora number, as the accent type of the character string.

The prosodic model selecting means 15 involves creating the syllabic information of the input character string, extracting the prosodic model data having the mora number and accent type coincident with those of the input character string from the prosody dictionary 12 to have a prosodic model data candidate, comparing the syllabic information for each prosodic model data candidate and the syllabic information of the input character string to create the prosodic reconstructed information, and selecting the optimal model data, based on the character string of each prosodic model data candidate and the prosodic reconstructed information thereof.

The prosody transforming means 16 involves calculating the syllable length after transformation from the average syllable length calculated ahead for all the characters for use in the voice synthesis and the syllable length of the prosodic model data, for every character not coincident in the prosodic model data, when the character string of the selected prosodic model data is not coincident with the input character string.

The waveform selecting means 17 involves selecting the waveform data of pertinent phoneme in the prosodic model data after transformation from the waveform dictionary, for the reconstructed phoneme of the phonemes making up an input character string, and selecting the waveform data of corresponding phoneme having the frequency closest to that of the prosodic model data after transformation from the waveform dictionary, for other phonemes.

The waveform connecting means 18 involves connecting the selected waveform data with each other to create the composite voice data.

The preferred embodiments of the invention as described in the present specification is only illustrative, but not limitation. The invention is therefore to be limited only by the scope of the appended claims. It is intended that all the modifications falling within the meanings of the claims are included in the present invention.

What is claimed is:

1. A speech synthesis method of creating voice message data corresponding to an input character string, comprising the steps of:

using (a) a word dictionary that stores a large number of character strings having at least one character with its accent type, (b) a prosody dictionary that stores typical prosodic model data among prosodic model data representing the prosodic information for the character strings stored in said word dictionary, and (c) a waveform dictionary that stores voice waveform data of a composition unit with a recorded voice;

determining the accent type of the input character string;

selecting the prosodic model data from said prosody dictionary, based on the input character string and the accent type;

transforming the prosodic information of said prosodic model data in accordance with the input character string in response to the character string of the selected prosodic model data not being coincident with the input character string;

selecting the waveform data corresponding to each character of the input character string from the waveform dictionary, based on the prosodic model data;

connecting the selected waveform data with each other;

storing the prosodic model data including the character string, a mora number, the accent type, and syllabic information in said prosody dictionary;

creating the syllabic information of an input character string;

providing a prosodic model candidate by extracting the prosodic model data having the mora number and accent type coincident to that of the input character string from said prosody dictionary;

creating prosodic reconstructed information by comparing the syllabic information of each prosodic model data candidate and the syllabic information of the input character string; and selecting an optimal prosodic model data based on the character string of each prosodic model data candidate and the prosodic reconstructed information thereof.

2. The speech synthesis method according to claim 1, wherein:

if there is any of the prosodic model data candidates having all its phonemes coincident with those of the input character string, making this prosodic model data candidate the optimal prosodic model data;

if there is no candidate having all its phonemes coincident with those of the input character string, making the candidate having the greatest number of coincident phonemes with those of the input character string among the prosodic model data candidates the optimal prosodic model data; and if there are plural candidates having the greatest number of phonemes coincident, making the candidate having the greatest number of phonemes consecutively coincident the optimal prosodic model data.

3. Apparatus for performing the method of claim 2.

4. The speech synthesis method according to claim 1, further including obtaining the syllable length after transformation from the average syllable length calculated ahead for all the characters used in the speech synthesis and the syllable length in said prosodic model data for every character not coincident among the prosodic model data in response to the character string of said selected prosodic model data not being coincident with the input character string.

5. Apparatus for performing the method of claim 4.

6. Apparatus for performing the method of claim 1.

7. A speech synthesis method of creating voice message data corresponding to an input character string, comprising the steps of:

using (a) a word dictionary that stores a large number of character strings having at least one character with its accent type, (b) a prosody dictionary that stores typical prosodic model data among prosodic model data representing the prosodic information for the character strings stored in said word dictionary, and (c) a waveform dictionary that stores voice waveform data of a composition unit with a recorded voice;

determining the accent type of the input character string;

selecting the prosodic model data from said prosody dictionary, based on the input character string and the accent type;

transforming the prosodic information of said prosodic model data in accordance with the input character string in response to the character string of the selected prosodic model data not being coincident with the input character string;

selecting the waveform data corresponding to each character of the input character string from the waveform dictionary, based on the prosodic model data;

selecting the waveform data of a pertinent phoneme in the prosodic model data from the waveform dictionary, the pertinent phoneme having a position and phoneme coincident with those of the prosodic model data for each phoneme making up an input character string; and selecting the waveform data of a corresponding phoneme having the frequency closest to that of the prosodic model data from said waveform dictionary for other phonemes.

8. The speech synthesis method according to claim 7, further including obtaining the syllable length after transformation from the average syllable length calculated ahead for all the characters for use in the voice synthesis and the syllable length in said prosodic model data for every character not coincident among the prosodic model data in response to the character string of said selected prosodic model data not being coincident with the input character string.

9. Apparatus for performing the method of claim 7.

10. A speech synthesis apparatus for creating voice message data corresponding to an input character string, comprising:

a word dictionary storing a large number of character strings including at least one character with its accent type;

a prosody dictionary storing typical prosodic model data among prosodic model data representing prosodic information for the character strings stored in said word dictionary, said prosody dictionary including the character string, mora number, accent type, and syllabic information;

a waveform dictionary storing voice waveform data of a composition unit with a recorded voice;

accent type determining means for determining the accent type of the input character string;

prosodic model selecting means for selecting the prosodic model data from said prosody dictionary, based on the input character string and the accent type;

prosodic transforming means for transforming the prosodic information of the prosodic model data in accordance with the input character string in response to the character string of said selected prosodic model data not being coincident with the input character string;

waveform selecting means for selecting the waveform data corresponding to each character of the input character string from said waveform dictionary, based on the prosodic model data;

waveform connecting means for connecting the selected waveform data with each other; and prosodic model selecting means for:

creating the syllabic information of an input character string, extracting the prosodic model data having the mora number and accent type coincident to those of the input character string from said prosody dictionary to provide a prosodic model candidate, creating prosodic reconstructed information by comparing the syllabic information of each prosodic model data candidate and the syllabic information of the input character string, and selecting an optimal prosodic model data based on the character string of each prosodic model data candidate and the prosodic reconstructed information thereof.

11. The speech synthesis apparatus according to claim 10, wherein the prosodic model selecting means is arranged so that:

(a) if there is any of the prosodic model data candidates having all its coincident phonemes with those of the input character string, this prosodic model data candidate is made the optimal prosodic model data by the prosodic model selecting means;

(b) if there is no candidate having all its phonemes coincident with those of the input character string, the candidate having the greatest number of phonemes coincident with the phonemes of the input character string among the prosodic model data candidates is made the optimal prosodic model data; and if there are plural candidates having the greatest number of phonemes coincident, the candidate having the greatest number of phonemes consecutively coincident is made the optimal prosodic model data.

12. The speech synthesis apparatus according to claim 10, further comprising prosody transforming means arranged to be responsive to the character string of said selected prosodic model data not being coincident with the input character string, for obtaining the syllable length after transformation from the average syllable length calculated ahead for all the characters for use in the speech synthesis and the syllable length in said prosodic model data for each character not coincident among the prosodic model data.

13. A speech synthesis apparatus for creating voice message data corresponding to an input character string, comprising:

a word dictionary storing a large number of character strings including at least one character having an accent type;

a prosody dictionary storing typical prosodic model data among prosodic model data representing prosodic information for the character strings stored in said word dictionary;

a waveform dictionary storing voice waveform data of a composition unit with a recorded voice;

accent type determining means for determining the accent type of the input character string;

prosodic model selecting means for selecting the prosodic model data from said prosody dictionary, based on the input character string and the accent type;

prosodic transforming means for transforming the prosodic information of the prosodic model data in accordance with the input character string in response to the character string of said selected prosodic model data not being coincident with the input character string;

waveform selecting means for:

selecting the waveform data corresponding to each character of the input character string from said waveform dictionary, based on the prosodic model data, selecting the waveform data of a pertinent phoneme in the prosodic model data from said waveform dictionary, the pertinent phoneme having a position and phoneme coincident with those of the prosodic model data for each phoneme making up an input character string, and selecting the waveform data of a phoneme having the frequency closest to that of the prosodic model data from said waveform dictionary for other phonemes; and waveform connecting means for connecting the selected waveform data with each other.

14. The speech synthesis apparatus according to claim 13, further comprising prosody transforming means for obtaining the syllable length after transformation is obtained from the average syllable length calculated ahead for all the characters for use in the voice synthesis and the syllable length in said prosodic model data for each character not coincident among the prosodic model data in response to the character string of said selected prosodic model data not being coincident with the input character string.

15. A computer-readable medium having stored thereon a speech synthesis program, wherein said program, when read by a computer, enables the computer to operate as:

a word dictionary for storing a large number of character strings including at least one character with its accent type;

a prosody dictionary for storing typical prosodic model data among prosodic model data representing prosodic information for the character strings stored in said word dictionary, said prosody dictionary including the character string, a mora number, accent type, and syllabic information; and a waveform dictionary for storing the voice waveform data of a composition unit with a recorded voice;

accent type determining means for determining the accent type of an input character string;

prosodic model selecting means for:

selecting the prosodic model data from said prosody dictionary, based on the input character string and the accent type, and creating the syllabic information of the input character string, extracting the prosodic model data having the mora number and accent type coincident to those of the input character string from said prosody dictionary to provide a prosodic model candidate, creating prosodic reconstructed information by comparing the syllabic information of each prosodic model data candidate and the syllabic information of the input character string, and selecting optimal prosodic model data based on the character string of each prosodic model data and the prosodic reconstructed information thereof;

prosodic transforming means for transforming the prosodic information of said prosodic model data in accordance with the input character string in response to the character string of said selected prosodic model data not being coincident with the input character string;

waveform selecting means for selecting the waveform data corresponding to each character of the input character string from said waveform dictionary, based on the prosodic model data; and waveform connecting means for connecting said selected waveform data with each other.

16. The computer-readable medium according to claim 15, wherein the program enables the computer to perform the following steps:

if there is any of the prosodic model data candidates having all its coincident phonemes with those of the input character string, making such prosodic model data candidate(s) the optimal prosodic model data;

if there is no candidate having all its phonemes coincident with those of the input character string, making the candidate having a greatest number of phonemes coincident with the phonemes of the input character string among the prosodic model data candidates the optimal prosodic model data; and if there are plural candidates having the greatest number of phonemes coincident, making the candidate having the greatest number of phonemes consecutively coincident the optimal prosodic model data.

17. The computer-readable medium according to claim 15, wherein said speech synthesis program further enables the computer to operate as prosody transforming means for obtaining the syllable length after transformation from the average syllable length calculated ahead for all the characters for use in the voice synthesis and the syllable length in said prosodic model data for each character not coincident among the prosodic model data in response to the character string of said selected prosodic model data not being coincident with the input character string.

18. A computer-readable medium having recorded thereon a speech synthesis program, wherein said program, when read by a computer, enables the computer to operate as:

a word dictionary for storing a large number of character strings including at least one character with its accent type, a prosody dictionary for storing typical prosodic model data among prosodic model data representing the prosodic information for the character strings stored in said word dictionary, and a waveform dictionary for storing the voice waveform data of a composition unit with the recorded voice;

accent type determining means for determining the accent type of an input character string;

prosodic model selecting means for selecting the prosodic model data from said prosody dictionary, based on the input character string and the accent type;

prosodic transforming means for transforming the prosodic information of said prosodic model data in accordance with the input character string in response to the character string of said selected prosodic model data not being coincident with the input character string;

waveform selecting means for selecting the waveform data corresponding to each character of the input character string from said waveform dictionary, based on the prosodic model data, and for selecting the waveform data of pertinent phoneme in the prosodic model data from said waveform dictionary, the pertinent phoneme having the position and phoneme coincident with those of the prosodic model data for every phoneme making up an input character string, and selecting the waveform data of phoneme having the frequency closest to that of the prosodic model data from said waveform dictionary for other phonemes; and waveform connecting means for connecting said selected waveform data with each other.

19. The computer-readable medium according to claim 18, wherein said speech synthesis program further enables the computer to operate as prosody transforming means for obtaining the syllable length after transformation is obtained from the average syllable length calculated ahead for all the characters for use in the voice synthesis and the syllable length in said prosodic model data for each character not coincident among the prosodic model data in response to the character string of said selected prosodic model data not being coincident with the input character string.

* * * * *